US012202030B2

(12) United States Patent
Macke et al.

(10) Patent No.: US 12,202,030 B2
(45) Date of Patent: Jan. 21, 2025

(54) CAN END WITH A COINED RIVET, TOOLING ASSEMBLY THEREFOR AND A METHOD OF FORMING

(71) Applicant: Stolle Machinery Company, LLC, Centennial, CO (US)

(72) Inventors: Christopher Lawrence Macke, Sidney, OH (US); Dennis Cornelius Stammen, Brookville, OH (US)

(73) Assignee: Stolle Machinery Company, LLC, Centennial, CO (US)

( * ) Notice: Subject to any disclaimer, the term of this patent is extended or adjusted under 35 U.S.C. 154(b) by 240 days.

(21) Appl. No.: 17/935,960

(22) Filed: Sep. 28, 2022

(65) Prior Publication Data

US 2023/0016790 A1 Jan. 19, 2023

Related U.S. Application Data

(62) Division of application No. 15/683,803, filed on Aug. 23, 2017, now abandoned.

(51) Int. Cl.

| | |
|---|---|
| ***B21D 51/38*** | (2006.01) |
| ***B21D 22/04*** | (2006.01) |
| ***B21D 22/06*** | (2006.01) |
| ***B21D 39/03*** | (2006.01) |
| ***B21D 51/10*** | (2006.01) |
| ***B21D 51/26*** | (2006.01) |
| ***B65D 17/34*** | (2006.01) |
| ***B65D 17/40*** | (2006.01) |

(52) U.S. Cl.

CPC ..... *B21D 51/383* (2013.01); *B21D 22/04* (2013.01); *B21D 22/06* (2013.01); *B21D 39/032* (2013.01); *B21D 51/10* (2013.01); *B21D 51/26* (2013.01); *B65D 17/34* (2018.01)

(58) Field of Classification Search

CPC ..... B21D 51/383; B21D 51/38; B21D 22/04; B21D 22/06; B21D 39/032

See application file for complete search history.

(56) References Cited

U.S. PATENT DOCUMENTS

| | | | | |
|---|---|---|---|---|
| 3,391,819 | A | 7/1968 | Henchert | |
| 3,638,597 | A | 2/1972 | Brown | |
| 3,871,314 | A * | 3/1975 | Stargell | B21D 51/383 413/6 |
| 4,017,000 | A | 4/1977 | Woodley | |
| 4,145,801 | A | 3/1979 | Schrecker et al. | |
| 4,580,692 | A | 4/1986 | LaBarge | |

(Continued)

FOREIGN PATENT DOCUMENTS

| | | |
|---|---|---|
| CN | 1315697 | 5/2007 |
| DE | 1652624 A1 | 9/1971 |

(Continued)

OTHER PUBLICATIONS

Japanese Patent Office, JP Patent Application No. 2023-051098, Office Action, Dec. 19, 2023, 2 pages, and English translation.

*Primary Examiner* — Mohammed S. Alawadi

(74) *Attorney, Agent, or Firm* — Eckert Seamans Cherin & Mellott, LLC

(57) ABSTRACT

A can end including a central panel and a coined rivet disposed on the central panel. A press, a station, and/or a tooling assembly structured to form a coined rivet as well as a method to form the coined rivet is also provided.

7 Claims, 12 Drawing Sheets

(56) References Cited

U.S. PATENT DOCUMENTS

| | | | | |
|---|---|---|---|---|
| 4,627,265 | A | 12/1986 | Bulso, Jr. et al. | |
| 4,678,096 | A | 7/1987 | LaBarge et al. | |
| 4,783,985 | A | 11/1988 | LaBarge et al. | |
| 5,749,257 | A * | 5/1998 | McEldowney ..... | B21D 51/383 72/356 |
| 5,755,134 | A | 5/1998 | McEldowney | |
| 5,851,685 | A | 12/1998 | McEldowney | |
| 6,035,689 | A | 3/2000 | Chang et al. | |
| 2002/0113069 | A1 | 8/2002 | Forrest | |
| 2008/0014050 | A1* | 1/2008 | Butcher ..... | B21D 51/383 100/56 |
| 2011/0147382 | A1 | 6/2011 | Mitchell et al. | |
| 2013/0264343 | A1 | 10/2013 | Neiner | |
| 2013/0292382 | A1 | 11/2013 | Bork | |
| 2014/0110408 | A1 | 4/2014 | Mitchell et al. | |
| 2014/0263329 | A1 | 9/2014 | Chasteen | |
| 2015/0251803 | A1 | 9/2015 | Rayburn | |

FOREIGN PATENT DOCUMENTS

| | | | |
|---|---|---|---|
| JP | 07-275976 | | 10/1995 |
| JP | 2007283364 | A | 11/2007 |
| JP | 2009020326 | A | 1/2009 |
| JP | 2013-514952 | A | 5/2013 |
| WO | 2002051710 | A1 | 7/2002 |
| WO | 2011079003 | A1 | 6/2011 |

* cited by examiner

CAN END WITH A COINED RIVET, TOOLING ASSEMBLY THEREFOR AND A METHOD OF FORMING

CROSS REFERENCE TO RELATED APPLICATIONS

This application is a divisional application of and claims priority to U.S. patent application Ser. No. 15/683,803, filed Aug. 23, 2017, entitled, CAN END WITH A COINED RIVET, TOOLING ASSEMBLY THEREFOR AND A METHOD OF FORMING.

FIELD OF THE INVENTION

The disclosed and claimed concept relates to can ends and, more particularly, to can ends made from a sheet material formed into a coined rivet. The disclosed concept also relates to a tooling assembly and associated methods for providing such can ends.

BACKGROUND OF THE INVENTION

Metallic containers (e.g., cans) are structured to hold products such as, but not limited to, food and beverages. Generally, a metallic container includes a can body and a can end. The can body, in an exemplary embodiment, includes a base and a depending sidewall. The can body defines a generally enclosed space that is open at one end. The can body is filled with product and the can end is then coupled to the can body at the open end. The container is, in some instances, heated to cook and/or sterilize the contents thereof. This process increases the internal pressure of the container. Further, the container contains, in some instances, a pressurized product such as, but not limited to a carbonated beverage. Thus, for various reasons, the container must have a minimum strength.

Generally, the strength of the container is related to the thickness of the metal from which the can body and the can end is formed, as well as, the shape of these elements. This application primarily addresses the can ends rather than the can bodies. The can ends are "easy open" ends which include a tear panel and a tab. The tear panel is defined by a score profile, or scoreline, on the exterior surface (identified herein as the "public side") of the can end. The tab is attached (e.g., without limitation, riveted) adjacent the tear panel. The pull tab is structured to be lifted and/or pulled to sever the scoreline and deflect and/or remove the severable panel, thereby creating an opening for dispensing the contents of the container.

When the can end is made, it originates as a blank, which is cut from a sheet metal product (e.g., without limitation, sheet aluminum, sheet steel). As used herein, a "blank" is a portion of material that is formed into a product; the term "blank" is applicable to the portion of material until all forming operations are complete. In an exemplary embodiment, the blank is formed into a "shell" in a shell press. As used herein, a "shell" or a "preliminary can end" is a construct that started as a generally planar blank and which has been subjected to forming operations other than scoring, paneling, rivet forming, and tab staking, as well as other stations as are known. The shell press includes a number of tool stations where each station performs a forming operation (or which may include a null station that does not perform a forming operation). The blank moves through successive stations and is formed into the "shell." That is, as a non-limiting example, a first station cuts the blank from the sheet material, a second station forms the blank into a cup-like construct with a depending sidewall, a third station forms the depending sidewall into a countersink and a chuck sidewall, and so forth.

For an "easy open" end, a shell is further conveyed to a conversion press, which also has a number of successive tool stations. As the shell advances from one tool station to the next, conversion operations such as, for example and without limitation, rivet forming, paneling, scoring, embossing, and tab staking (i.e., coupling a tab to the shell via the rivet), are performed until the shell is fully converted into the desired can end and is discharged from the press. Further, the process of creating a rivet and coupling a tab thereto are disclosed in U.S. Pat. No. 4,145,801 and the Description of the Preferred Embodiments in U.S. Pat. No. 4,145,801 is incorporated herein by reference.

In the can making industry, large volumes of metal are required in order to manufacture a considerable number of cans. Thus, an ongoing objective in the industry is to reduce the amount of metal that is consumed. Efforts are constantly being made, therefore, to reduce the thickness or gauge (sometimes referred to as "down-gauging") of the stock material from which can ends, tabs, and can bodies are made. Presently, can ends are made from sheet metal such as, but not limited to aluminum and steel as well as alloys including those metals. The minimum base thickness for these materials is 0.0082 inch. This is a problem and using a metal material with a thinner base thickness would solve this problem.

Use of a material with a thinner base thickness, however, generates other problems such as, but not limited to, failure of the can end at the rivet. That is, a rivet formed from a material with a base thickness less than 0.0082 inch cannot hold the tab to the can end. This is a problem.

Alternatively, material with a thicker base thickness can be thinned to have a thinner, or partially thinner, final thickness that is less than the base thickness. However, as less material (e.g., thinner gauge) is used, problems arise that require the development of unique solutions. Further, the process of forming the can bodies and can ends cause stress in the material thereby damaging the can bodies or can ends during the forming thereof.

One solution to the problems associated with using thin metal is to provide strengthening constructs in the can end. For example, as disclosed in U.S. Pat. No. 5,755,134, the process of creating a rivet includes forming a bubble in the generally planar blank prior to forming the rivet. As stated in U.S. Pat. No. 5,755,134, forming the bubble includes "moving [ ] sufficient metal into the bubble from the end panel so that a rivet can be formed in subsequent operations . . . ." That is, to increase the strength of the rivet both during and after forming operations, metal is forced into the area that becomes the rivet. Stated alternately, the base thickness of the blank is increased in the area that becomes the rivet. Increasing the base thickness of the area that becomes the rivet means decreasing the thickness in other areas of the can end. This is a problem.

Further, prior to staking, the known rivet buttons have a tapered cross-sectional shape. When a rivet button with such a shape is staked, the rivet button is prone to collapse unevenly. That is, a portion of the rivet may extend over the tab more in one direction than another. This is a problem.

There is, therefore, a need for a can end rivet that does not decrease the material thickness of other areas of the can end. Further, there is a need to decrease the amount of material in the rivet so as to decrease the total amount of material used to create the can end. Further, there is a need to form can ends from a material having a base thickness of less than 0.0082 inch.

SUMMARY OF THE INVENTION

The disclosed and claimed concept provides a can end including a central panel and a coined rivet button disposed on the central panel. The disclosed and claimed concept provides a press, a station, and/or a tooling assembly structured to form a coined rivet as well as a method to form the coined rivet.

BRIEF DESCRIPTION OF THE DRAWINGS

A full understanding of the invention can be gained from the following description of the preferred embodiments when read in conjunction with the accompanying drawings in which.

DETAILED DESCRIPTION OF THE INVENTION

Figure 1:
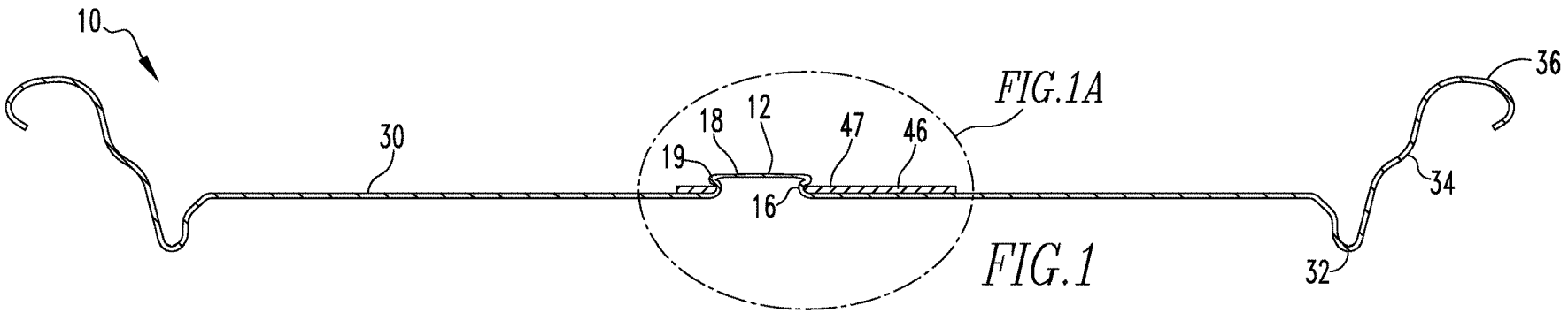
FIG. 1 is a partially schematic, cross-sectional side view of a can end with a coined rivet.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations, assembly, number of components used, embodiment configurations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies. As such, as used herein, "structured to [verb]" recites structure and not function. Further, as used herein, "structured to [verb]" means that the identified element or assembly is intended to, and is designed to, perform the identified verb. Thus, an element that is merely capable of performing the identified verb but which is not intended to, and is not designed to, perform the identified verb is not "structured to [verb]."

As used herein, "associated" means that the elements are part of the same assembly and/or operate together, or, act upon/with each other in some manner. For example, an automobile has four tires and four hub caps. While all the elements are coupled as part of the automobile, it is understood that each hubcap is "associated" with a specific tire.

As used herein, a "coupling assembly" includes two or more couplings or coupling components. The components of a coupling or coupling assembly are generally not part of the same element or other component. As such, the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut.

As used herein, a "fastener" is a separate component structured to couple two or more elements. Thus, for example, a bolt is a "fastener" but a tongue-and-groove coupling is not a "fastener." That is, the tongue-and-groove elements are part of the elements being coupled and are not a separate component.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof. Further, an object resting on another object held in place only by gravity is not "coupled" to the lower object unless the upper object is otherwise maintained substantially in place. That is, for example, a book on a table is not coupled thereto, but a book glued to a table is coupled thereto.

As used herein, the phrase "removably coupled" or "temporarily coupled" means that one component is coupled with another component in an essentially temporary manner. That is, the two components are coupled in such a way that the joining or separation of the components is easy and would not damage the components. For example, two components secured to each other with a limited number of readily accessible fasteners, i.e., fasteners that are not difficult to access, are "removably coupled" whereas two components that are welded together or joined by difficult to access fasteners are not "removably coupled." A "difficult to access fastener" is one that requires the removal of one or more other components prior to accessing the fastener wherein the "other component" is not an access device such as, but not limited to, a door.

As used herein, "temporarily disposed" means that a first element(s) or assembly (ies) is resting on a second element(s) or assembly(ies) in a manner that allows the first element/assembly to be moved without having to decouple or otherwise manipulate the first element. For example, a book simply resting on a table, i.e., the book is not glued or fastened to the table, is "temporarily disposed" on the table.

As used herein, "operatively coupled" means that a number of elements or assemblies, each of which is movable between a first position and a second position, or a first configuration and a second configuration, are coupled so that as the first element moves from one position/configuration to the other, the second element moves between positions/configurations as well. It is noted that a first element may be "operatively coupled" to another without the opposite being true.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are to fit "snugly" together. In that situation, the difference between the size of the components is even smaller whereby the amount of friction increases. If the element defining the opening and/or the component inserted into the opening are made from a deformable or compressible material, the opening may even be slightly smaller than the component being inserted into the opening. With regard to surfaces, shapes, and lines, two, or more, "corresponding" surfaces, shapes, or lines have generally the same size, shape, and contours.

As used herein, a "path of travel" or "path," when used in association with an element that moves, includes the space an element moves through when in motion. As such, any element that moves inherently has a "path of travel" or "path." Further, a "path of travel" or "path" relates to a motion of one identifiable construct as a whole relative to another object. For example, assuming a perfectly smooth road, a rotating wheel (an identifiable construct) on an automobile generally does not move relative to the body (another object) of the automobile. That is, the wheel, as a whole, does not change its position relative to, for example, the adjacent fender. Thus, a rotating wheel does not have a "path of travel" or "path" relative to the body of the automobile. Conversely, the air inlet valve on that wheel (an identifiable construct) does have a "path of travel" or "path" relative to the body of the automobile. That is, while the wheel rotates and is in motion, the air inlet valve, as a whole, moves relative to the body of the automobile.

As used herein, the statement that two or more parts or components "engage" one another means that the elements exert a force or bias against one another either directly or through one or more intermediate elements or components. Further, as used herein with regard to moving parts, a moving part may "engage" another element during the motion from one position to another and/or may "engage" another element once in the described position. Thus, it is understood that the statements, "when element A moves to element A first position, element A engages element B," and "when element A is in element A first position, element A engages element B" are equivalent statements and mean that element A either engages element B while moving to element A first position and/or element A either engages element B while in element A first position.

As used herein, "operatively engage" means "engage and move." That is, "operatively engage" when used in relation to a first component that is structured to move a movable or rotatable second component means that the first component applies a force sufficient to cause the second component to move. For example, a screwdriver may be placed into contact with a screw. When no force is applied to the screwdriver, the screwdriver is merely "temporarily coupled" to the screw. If an axial force is applied to the screwdriver, the screwdriver is pressed against the screw and "engages" the screw. However, when a rotational force is applied to the screwdriver, the screwdriver "operatively engages" the screw and causes the screw to rotate. Further, with electronic components, "operatively engage" means that one component controls another component by a control signal or current.

As used herein, the word "unitary" means a component that is created as a single piece or unit. That is, a component that includes pieces that are created separately and then coupled together as a unit is not a "unitary" component or body.

As used herein, the term "number" shall mean one or an integer greater than one (i.e., a plurality). That is, for example, the phrase "a number of elements" means one element or a plurality of elements.

As used herein, in the phrase "[x] moves between its first position and second position," or, "[y] is structured to move [x] between its first position and second position," "[x]" is the name of an element or assembly. Further, when [x] is an element or assembly that moves between a number of positions, the pronoun "its" means "[x]," i.e., the named element or assembly that precedes the pronoun "its."

As used herein, "about" in a phrase such as "disposed about [an element, point or axis]" or "extend about [an element, point or axis]" or "[X] degrees about an [an element, point or axis]," means encircle, extend around, or measured around. When used in reference to a measurement or in a similar manner, "about" means "approximately," i.e., in an approximate range relevant to the measurement as would be understood by one of ordinary skill in the art.

As used herein, a "radial side/surface" for a circular or cylindrical body is a side/surface that extends about, or encircles, the center thereof or a height line passing through the center thereof. As used herein, an "axial side/surface" for a circular or cylindrical body is a side that extends in a plane extending generally perpendicular to a height line passing through the center. That is, generally, for a cylindrical soup can, the "radial side/surface" is the generally circular sidewall and the "axial side(s)/surface(s)" are the top and bottom of the soup can.

As used herein, "generally curvilinear" includes elements having multiple curved portions, combinations of curved portions and planar portions, and a plurality of planar portions or segments disposed at angles relative to each other thereby forming a curve.

As used herein, "generally" means "in a general manner" relevant to the term being modified as would be understood by one of ordinary skill in the art.

As used herein, "substantially" means "for the most part" relevant to the term being modified as would be understood by one of ordinary skill in the art.

As used herein, "at" means on and/or near relevant to the term being modified as would be understood by one of ordinary skill in the art.

As used herein, a "coined rivet button" is a portion of a blank 20 for a can end 10 that includes a coined top portion 18. (All reference numbers discussed below.) That is, a bubble 38 is formed into an unstaked rivet or button. That is, a "button" is a rivet prior to the staking operation that couples a tab 46 (discussed below) thereto. The bubble 38 includes a rivet portion top portion 44 that is coined when forming the "coined rivet button" That is, the rivet portion top portion 44 is coined and becomes a generally planar top portion 18 of both the "coined rivet button" 14 and the "coined rivet" 12. Further, to be a "coined rivet button" 14, the area immediately about (encircling) the rivet portion top portion 44 (the rivet portion sidewall portion 42, as discussed below) is not coined when forming the "coined rivet button" or thereafter. Thus, a "coined rivet button," as used herein, includes a coined top portion 18 and an un-coined sidewall portion 16.

As used herein, a "coined rivet" 12 is a rivet formed from a "coined rivet button" 14 and which includes a coined top portion 18.

As used herein, to "coin" means to simultaneously engage opposing sides of the blank 20 and induce plastic flow on the surface of the material. As is known, coining material work hardens the surface(s), while the material therebetween retains its toughness and ductility.

The following description provides for forming a "coined rivet button" 14 on a can end 10 and the subsequent "coined rivet" 12 created by staking a tab 46 to the "coined rivet button" These elements, and the tooling and associated method used to create these elements, however, can also be incorporated into a shell and the tooling and method of creating that shell. That is, in a shell press (not shown), the portion of the shell that will form the rivet top portion is coined. In an exemplary embodiment, the portion of the shell that will form the rivet is coined while the material is generally planar. In another embodiment, a bubble is formed in the shell blank, the portion of the shell that will form the rivet top portion is coined, and the bubble is reformed into a generally planar portion of the shell. The tooling and the method structured to form such a coined portion of the shell are similar to the coining surfaces 578, 579 (discussed below) and the coining method discussed below. The following description now focuses on creating a coined rivet 14 in a can end 10 rather than a shell or preliminary can end.

The following discussion and the Figures use a generally cylindrical can end 10, FIG. 1, as an example. It is understood that the disclosed and claimed concept is operable with can ends 10 of any shape and the cylindrical shape discussed and shown is exemplary only. Further, in an exemplary embodiment and for the dimensions described below, the can end is made from aluminum or aluminum alloys and is structured to be coupled to a beverage can; that is, a can structured to contain a beverage such as beer or carbonated beverages. One non-limiting example of a beverage can is a 12 ounce beverage can. It is understood, however, that the concept disclosed below is also applicable to can ends made of other materials such as, but not limited to, steel and steel alloys. It is further understood that steel cans and can ends are typically made from material with a base thickness thinner than aluminum can ends. Thus, a steel can end that includes the down-gauging concept disclosed herein would have a thinner base thickness than the dimensions for an aluminum can, as described below, and a thinner base thickness than the metal used to make the can ends that do not include the down-gauging concept disclosed herein.

Figure 2:
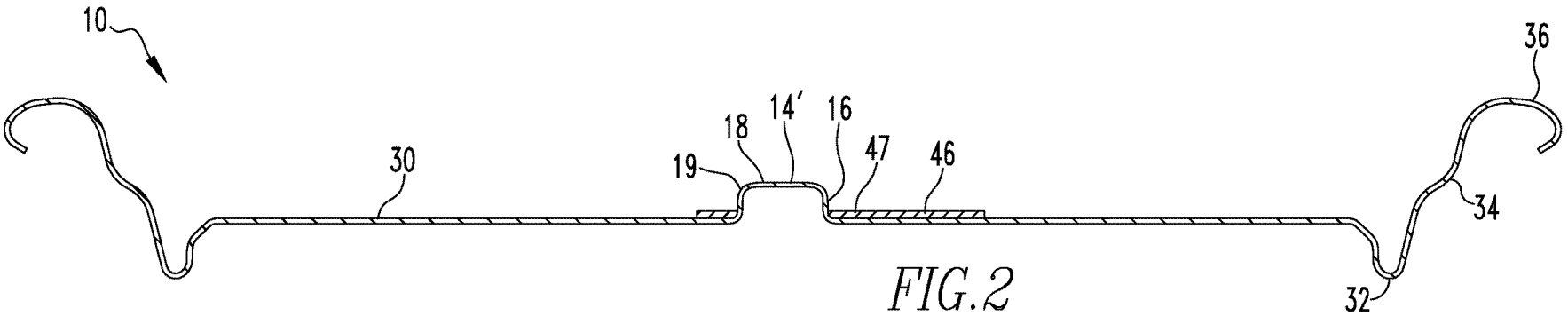
FIG. 2 is a cross-sectional side view of a can end with a coined rivet button.

As is generally known, a can end 10 is structured to be, and is, coupled, directly coupled, or fixed in a sealed manner to a can body (not shown) to form a container (not shown). The can end includes a generally planar central panel 30, discussed below, and a coined rivet 12, as defined below. The coined rivet 12 is formed from a coined rivet button 14 (FIG. 2). That is, a coined rivet button 14 protrudes upwardly, as shown, from the central panel 30 and includes a sidewall 16 and a generally planar top portion 18. The terms sidewall 16 and top portion 18 describe the same elements of both the coined rivet 12 and the coined rivet button 14 and the same names/reference numbers are used to describe these common elements.

In an exemplary embodiment, the can end 10 is formed from a sheet material having a base thickness that is less than 0.0082 inch. This solves the problems stated above. As used herein, the base thickness of the sheet material 22 is also the "average thickness" of the un-coined portions of the central panel 30, discussed below. As used herein, the "thickness" is measured along a line substantially normal to the surface of the material or the blank 20. The coining process, described below, reduces the thickness of the top portion 18 to a thickness of less than 0.0082 inch. In an exemplary embodiment, the top portion 18 has a thickness of between about 0.003 to less than 0.0082 inch. In this example, the sheet material 22 is formed into a can end 10, for a container structured to hold carbonated beverage, i.e., a "soda" or "pop" can. Further details of the coined rivet button 14 and the coined rivet 12 are discussed below.

Figure 3:
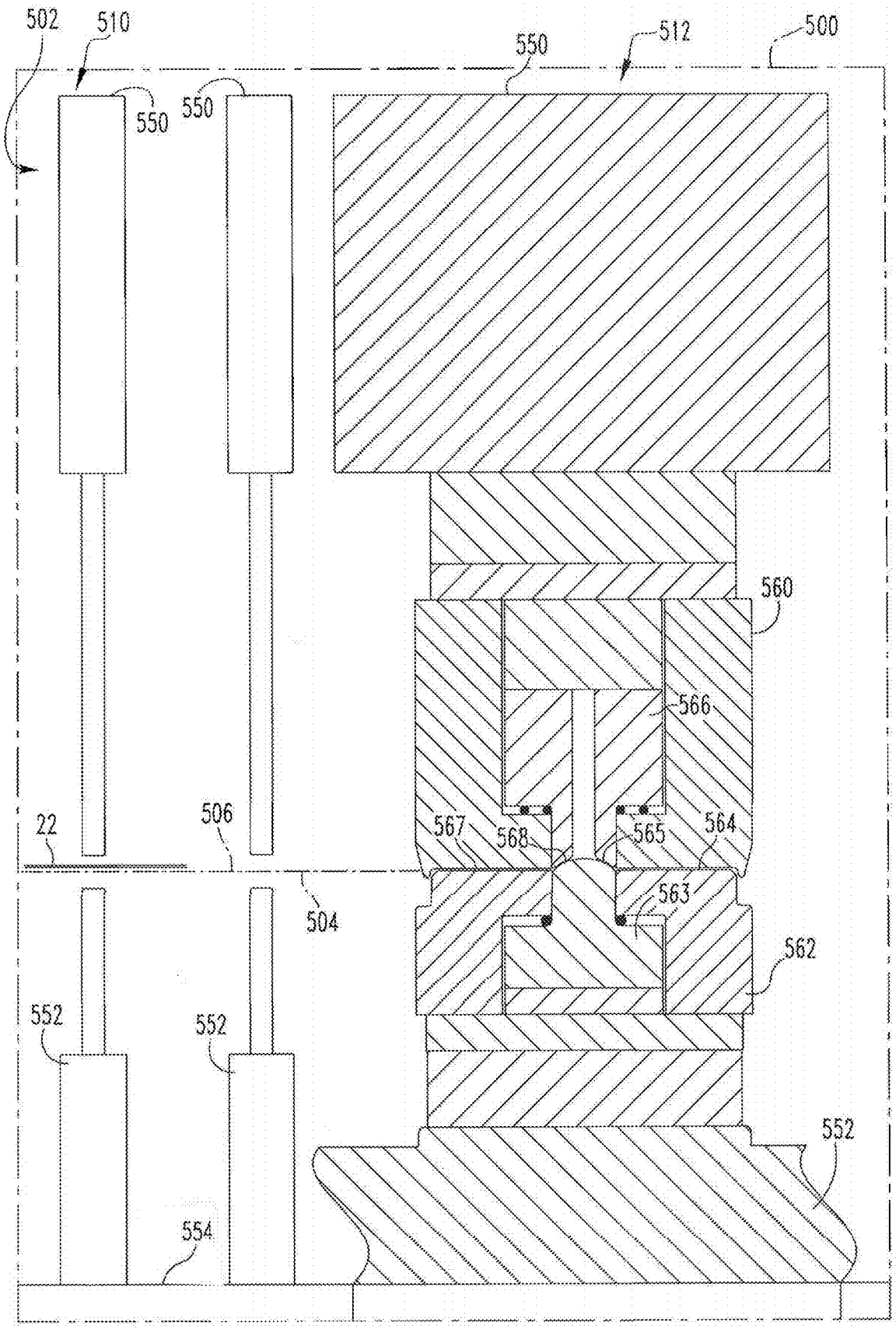
FIG. 3 is a partially schematic, cross-sectional side view of a press with a number of stations including a bubble station.

The can end 10 is, initially, a blank 20 cut from a sheet 22 of generally planar material such as, but not limited to aluminum, steel, or alloys of either. That is, in an exemplary embodiment, the sheet 22 of generally planar material (hereinafter, "sheet material" 22) is provided to a press 500, shown schematically FIG. 3, such as a conversion press, that is structured to, and does, form the sheet material 22 into a can end 10 (FIG. 1). Alternatively, the sheet material 22 is formed into a shell, hereinafter shell blank 20, in a shell press (not shown). The shell blanks 20 are then provided to the press 500, also identified as a "conversion press 500."

The press 500 includes a number of stations 502 (some shown schematically) each of which perform a number of forming operations on the shell blank 20. The shell blank 20 moves through the conversion press 500 on a conveyor 504, shown schematically, that is structured to, and does, move with an intermittent, or indexed, motion. In an exemplary embodiment, the conveyor 504 is a belt 506 (shown schematically) including a number of recesses, not shown. The belt 506 moves a set distance then stops before moving the set distance again. As the belt 506 moves, a blank 20 is moved sequentially through the conversion press number of stations 502 where, as noted above, each station 502 performs a single forming operation, or a number of forming operations, on the blank 20.

The conversion press 500, or stated alternately each station 502 thereof, includes an upper tooling assembly 550 and a lower tooling assembly 552. The upper tooling assembly 550 and a lower tooling assembly 552 for multiple stations 502 are, in an exemplary embodiment, unitary or coupled and support the dies, punches and other elements of each station. In this configuration, the upper tooling assemblies 550 for the stations move at the same time and are driven by a single drive assembly (not shown). For the purpose of identifying specific components, elements of a tooling assembly are also identified as parts of a specific station 502. That is, for example, the upper tooling assembly 550 at the bubble station 512, discussed below, is also identified as the bubble station upper tooling assembly 560. It is understood that any specifically identified upper tooling assembly 550 or lower tooling assembly 552, e.g. a "first rivet station upper tooling assembly," are generally part of the upper/lower tooling assemblies 550/552, respectively and the identifier/name merely indicates the nature of the station.

The conversion press 500 further includes a frame 554 and a drive assembly. In an exemplary embodiment, the lower tooling assembly 552 is fixed to the frame 554 and is substantially stationary. The upper tooling assembly 550 is movably coupled to the frame 554 and is structured to move from a first position, wherein the upper tooling assembly 550 is spaced from the lower tooling assembly 552, and a second position, wherein the upper tooling assembly 550 is closer to, and in an exemplary embodiment, immediately adjacent, the lower tooling assembly 552. The lower tooling assembly 552 is, in an exemplary embodiment, coupled, directly coupled, or fixed to the frame 554.

It is understood that, generally, the belt 506 moves when the upper tooling assembly 550 is in (or moving toward or away from) the first position. Conversely, the belt 506 is stationary when the upper tooling assembly 550 is in the second position. As is known, the drive assembly is structured to, and does, move the upper tooling assembly 550 between the first and second positions. Further, and as is known, the upper tooling assembly 550 and the lower tooling assembly 552 include separately movable elements, e.g., punches, dies, spacers, pads, risers and other sub-elements (collectively hereinafter "sub-elements"), that are structured to, and do, move separately from each other. All elements, however, generally move with the upper tooling assembly 550 between first and second positions. That is, generally, the motions of the sub-elements are relative to each other but as a whole, the upper tooling assembly 550 moves between the first position and the and second position as described above. Further, it is understood that the drive assembly includes cams, linkages, and other elements that are structured to move the sub-elements of the upper tooling assembly 550 and the lower tooling assembly 552 in the proper order. That is, selected sub-elements of the upper tooling assembly 550 and the lower tooling assembly 552 are structured to move independently of other selected sub-elements and a specific selected sub-element. For example, one selected sub-element is structured to move into, and dwell, at the second position while another sub-element moves into and out of the second position. Such selective motion of the sub-elements is known in the art.

Figure 4:
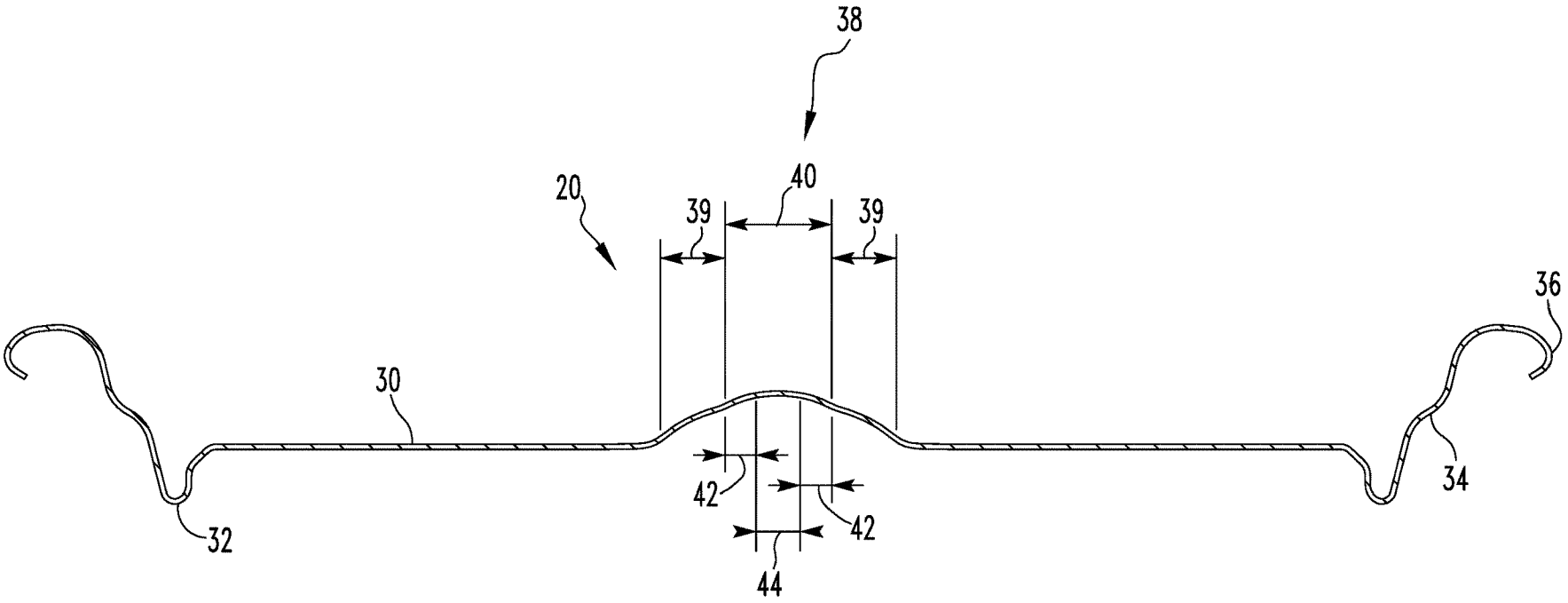
FIG. 4 is a cross-sectional side view of a blank with a bubble.
Figure 10:
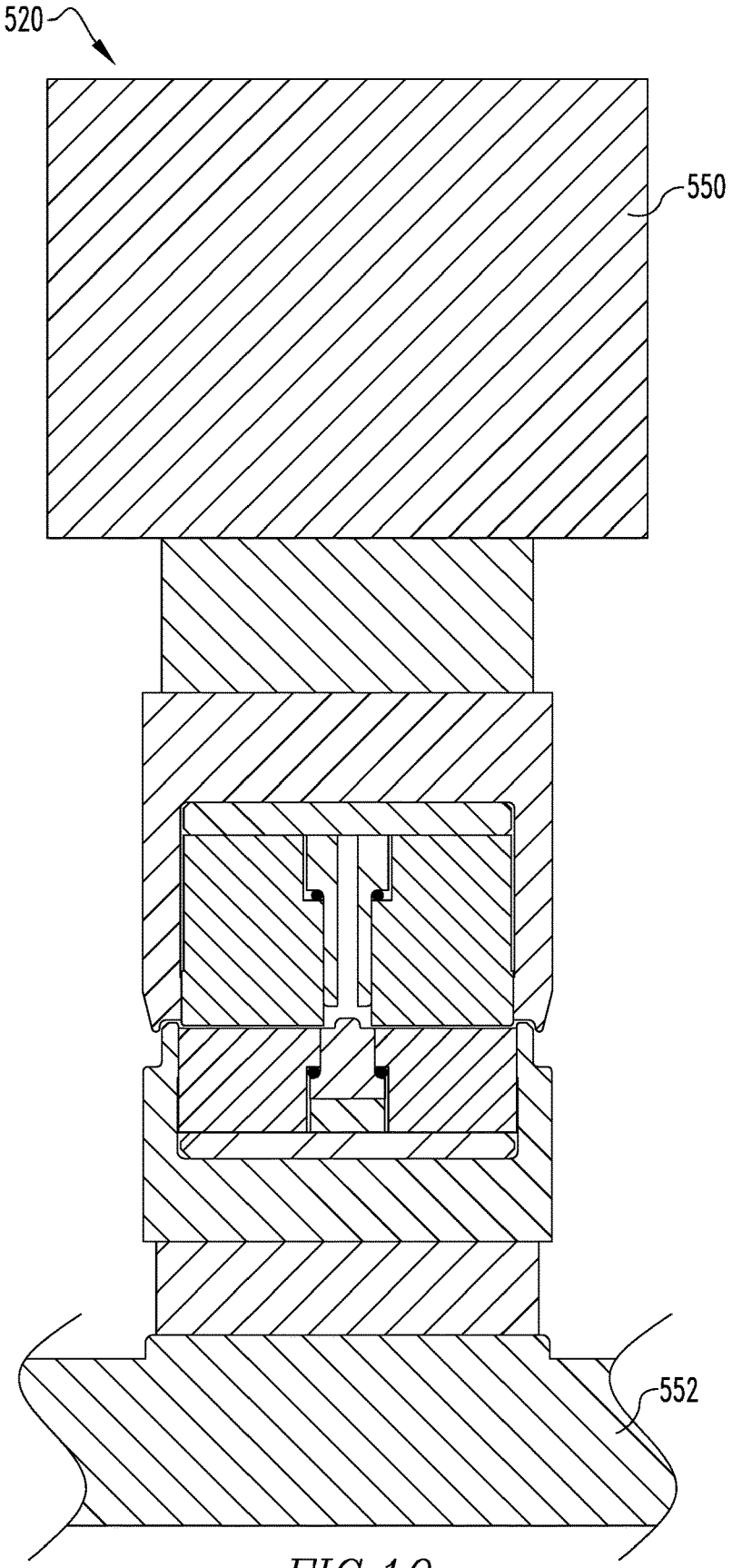
FIG. 10 is a cross-sectional side view of a panel station.
Figure 11:
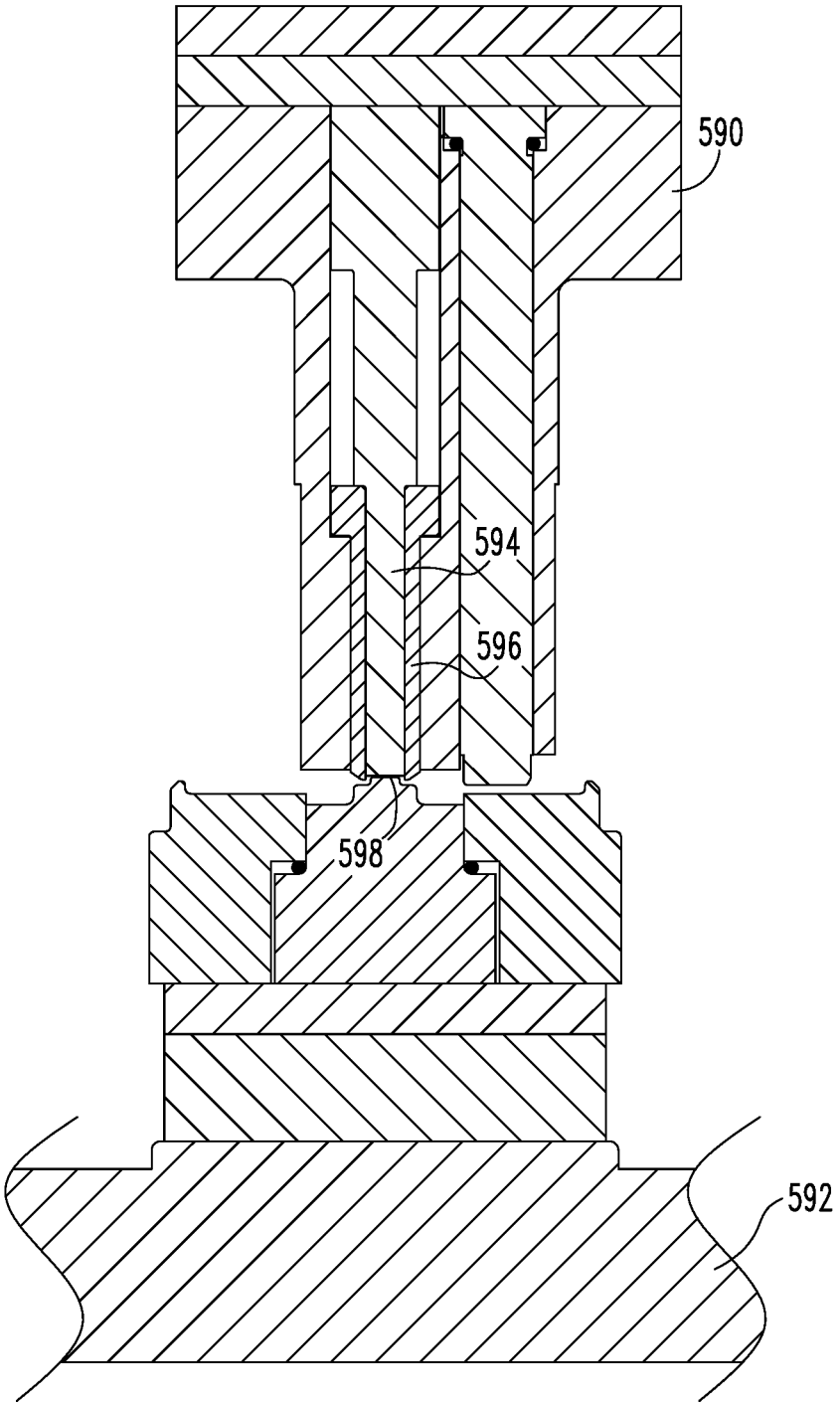
FIG. 11 is a cross-sectional side view of a stake station.

For the sake of this disclosure, it is assumed that a blank shell 20, i.e., a blank including a central panel 30, an annular countersink 32, a chuck wall 34, and a curl 36, as shown in FIGS. 1 and 2, is provided to the conversion press 500. As is known, conversion generic press stations 502 (as shown in the Figures, known stations are generically identified by reference number 502) perform forming operations on the shell blank 20 that are not relevant to this disclosure. For the purpose of this application, the following stations are identified: a bubble station 512 (FIG. 3), a first rivet station 514 (FIG. 5), a second rivet station 516 (FIG. 7), a score station 518 (FIG. 9), a panel station 520 (FIG. 10), and a stake station 522 (FIG. 11). In an exemplary embodiment, the first rivet station 514 is a "coining" rivet station 514 that is structured to, and does, form a "coined rivet button" 14 that becomes a "coined rivet" 12. Initially, the shell blank 20 is moved into the bubble station 512, FIG. 3, that includes a bubble station upper tooling assembly 560 and a bubble station lower tooling assembly 562. Generally, the bubble station lower tooling assembly 562 includes a die 563 having an annular generally planar portion 564 and a central domed portion 565. The bubble station upper tooling assembly 560 includes a punch 566 having an annular generally planar portion 567 and a domed portion 568. A blank 20 with a generally planar central panel 30 (not shown) is disposed between the bubble station upper tooling assembly 560 and the bubble station lower tooling assembly 562. When the bubble station upper tooling assembly 560 moves to the second position, a bubble 38 is formed thereon, as shown in FIG. 4. As shown in FIG. 4, a bubble 38 is generally arcuate, or generally curvilinear, when viewed in cross-section. The bubble 38 includes an outer periphery 39 and a "rivet portion" 40. As is known, and in an exemplary embodiment, the outer periphery 39 is coined during the formation of the bubble 38. As used herein, the "rivet portion" 40 is that portion of the bubble 38 that becomes the rivet button 14 and then the rivet 12. Further, the rivet portion 40 includes a sidewall portion 42 and a top portion 44. The rivet portion sidewall portion 42 becomes the rivet button sidewall 16 and then the coined rivet sidewall 16. Similarly, the top portion 44 becomes the coined rivet button top portion 18 and then the coined rivet top portion 18. Stated alternately, the outer periphery 39 is disposed concentrically about the sidewall portion 42. Further, the sidewall portion 42 is disposed concentrically about the top portion 44. In an exemplary embodiment, the outer periphery 39 is disposed concentrically about and immediately adjacent the sidewall portion 42, and, the sidewall portion 42 is disposed concentrically about and immediately adjacent the top portion 44.

As noted, when the bubble 38 is formed, the outer periphery 39 thereof is coined. The bubble outer periphery 39 subsequently becomes the area of the central panel 30 disposed about (encircling) the rivet 12. In an exemplary embodiment, the bubble outer periphery 39 has a thickness of between about 0.005 inch and 0.008 inch, or about 0.0065 inch. Further, the bubble outer periphery 39 is, in an exemplary embodiment, thicker than the thickness of the coined top portion 18, discussed below. That is, if the coined top portion 18 is at the upper end of its thickness range, the outer periphery 39 is also at the upper end of its thickness range. If the coined top portion 18 is at the lower end of its thickness range, the outer periphery 39 is anywhere in its thickness range, so long as the coined outer periphery 39 is thicker than the coined top portion 18. Further, as noted above, the un-coined portions of the central panel 30 disposed about the outer periphery 39 have a thickness equal to the base thickness of the sheet material 22, i.e., the average thickness.

Figure 5:
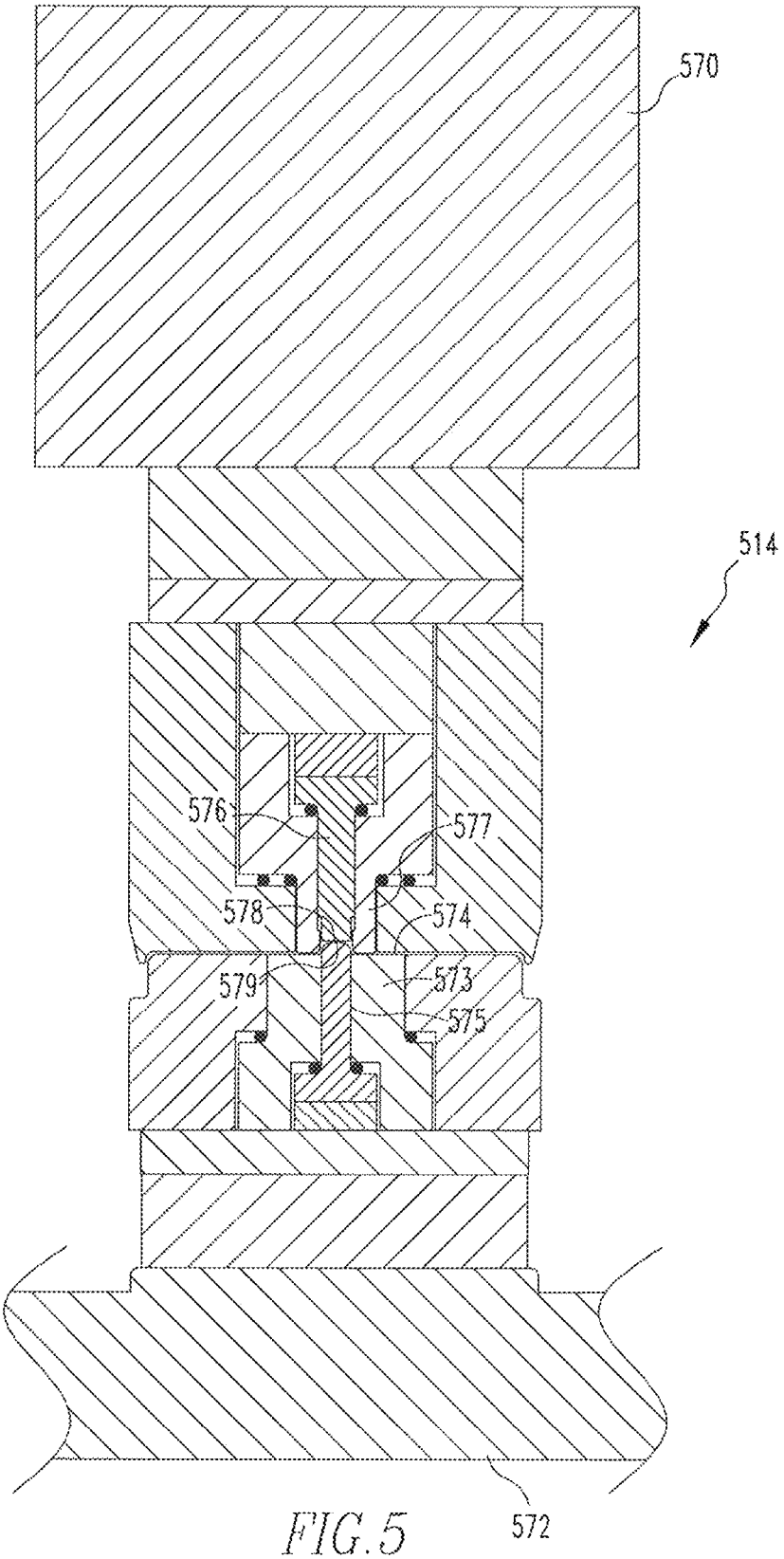
FIG. 5 is a cross-sectional side view of a coining first rivet station.

The shell blank 20 is then moved to the coining rivet station 514. The coining rivet station 514, FIG. 5, is structured to, and does, form the bubble 38 into a coined rivet button 14. The coining rivet station 514 includes a coining rivet station upper tooling assembly 570 and a coining rivet station lower tooling assembly 572. Generally, the coining rivet station lower tooling assembly 572 includes a die 573 having an annular generally planar portion 574 and a central punch 575. The coining rivet station upper tooling assembly 570 includes a central punch 576, and an outer annular punch 577 disposed about (encircling) the central punch 576. Pads (not numbered) structured to hold the blank 20 are disposed about the coining rivet station lower tooling assembly die 573 and coining rivet station lower tooling assembly central punch 575, as well as the coining rivet station upper tooling assembly punches 576, 577.

The coining rivet station upper tooling assembly central punch 576 defines a first coining surface 578 (hereinafter, "first coining surface" 578, or, "upper tooling assembly first coining surface" 578). In an exemplary embodiment, the first coining surface 578 is substantially planar. Similarly, the coining rivet station lower tooling assembly central punch 575 defines a second coining surface 579 (hereinafter, "second coining surface" 579 or "lower tooling assembly second coining surface" 579). In an exemplary embodiment, the second coining surface 579 is also substantially planar. The coining rivet station lower tooling assembly planar portion 574 is disposed opposite the coining rivet station upper tooling assembly annular punch 577. Further, the coining rivet station lower tooling assembly central punch 575 is disposed opposite the coining rivet station upper tooling assembly central punch 576. The coining rivet station lower tooling assembly central punch 575 and the coining rivet station upper tooling assembly central punch 576 operatively engage, and coin, the rivet portion top portion 44. That is, the first coining surface 578 is structured to, and does, move between a first position, wherein the first coining surface 578 is spaced from the second coining surface 579, and a second position, wherein the first coining surface 578 is a coining distance from the second coining surface 579. As used herein, a "coining distance" is a distance between two surfaces sufficiently close so as to coin material disposed between the two surfaces. Thus, when the first coining surface 578 and the second coining surface 579 are in the second position, the first coining surface 578 and the second coining surface 579 are structured to, and do, form a rivet coined top portion 18. Hereinafter, the "top portion 18" is identified as the "coined rivet top portion 18" both because it is part of the coined rivet button 14 (or coined rivet 12) and because the metal thereof is "coined." Conversely, the sidewall 16 is still identified hereinafter as the "sidewall 16." That is, while the sidewall 16 is part of the coined rivet button 14, the metal of the sidewall 16 is not coined and the term "coined rivet sidewall portion" may imply that the sidewall 16 is also coined.

That is, the coining rivet station lower tooling assembly central punch 575 and the coining rivet station upper tooling assembly central punch 576 operatively engage the outer periphery of the bubble 38 and return the outer periphery of the bubble 38 to the plane of the central panel 30 while the coined rivet top portion 18 is being formed. The coined rivet top portion 18 is not in the same plane as the central panel 30; thus, the rivet portion sidewall portion 42 is formed over the coining rivet station lower tooling assembly central punch 575, as is generally known. The rivet portion sidewall portion 42 is not coined.

Figure 1A:
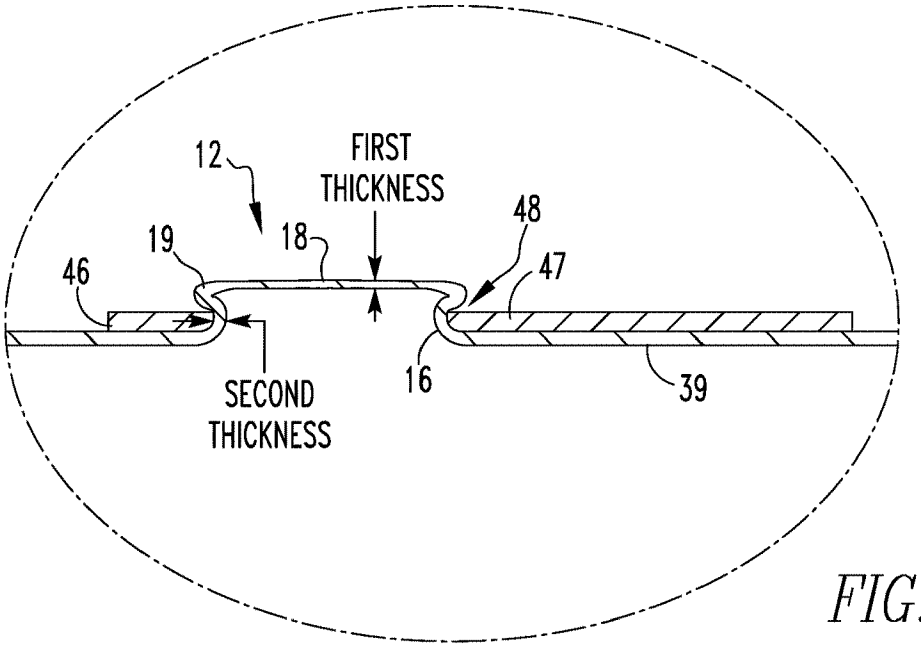
FIG. 1A is a detail view of the coined rivet.

That is, the rivet portion top portion 44 is coined and becomes the thinner and more rigid top portion 18. At the same time, a portion of material from the rivet portion top portion 44 flows into the sidewall portion 42 as that portion becomes the sidewall 16. In an exemplary embodiment, the top portion 18 has a first thickness and the sidewall 16 has a second thickness. The first thickness is less than the second thickness, as shown in FIG. 1A. Moreover, the sidewall 16 is not coined and is therefore more ductile than the coined rivet top portion 18 or the coined portion of the central panel 30 (formerly the coined outer periphery 39 as described above). In an exemplary embodiment, the top portion 18 first thickness is between more than 0.003 inch and less than 0.0082 inch or about 0.004 inch. In another embodiment, the top portion 18 first thickness is between about 0.004 inch and less than 0.008 inch or about 0.006 inch. In another exemplary embodiment, the top portion 18 first thickness is less than 0.0082 inch.

In an exemplary embodiment, the plane of the coined rivet top portion 18 extends generally parallel to the plane of the central panel 30. The sidewall 16, when viewed in cross-section, has an angle ($\alpha$) of between about 70° and 90° or about 90° relative to the plane of the central panel 30, as shown in FIG. 6. In another exemplary embodiment, the sidewall 16, when viewed in cross-section, has an angle ($\alpha$) of less than 90° but more than 80°. A coined rivet button 14 uses less material than a non-coined rivet button and therefore solves the problems noted above. Further, as used herein, a coined rivet button 14 that is initially formed with a coined top portion 18 at the first rivet station 514 is, as used herein, an "initially coined rivet button." Coining the top portion 18 at a first rivet station reduces the amount of metal that flows into the top portion 18 during subsequent forming operations thereby solving the problems stated above. In an alternate embodiment, the second rivet station 516 is the "coining" rivet station.

Figure 6A:
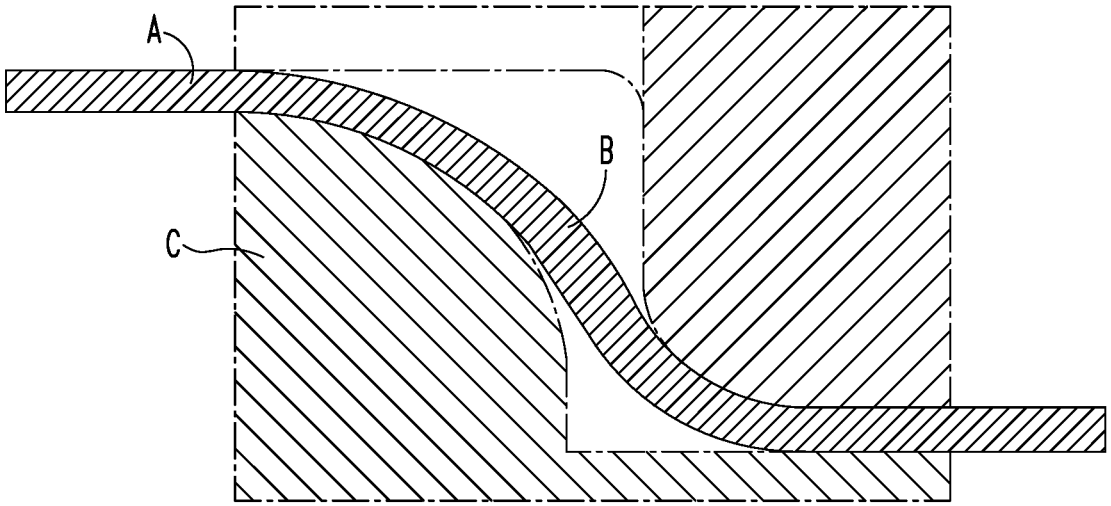
FIG. 6A (PRIOR ART)
FIG. 6A is a detail view of a prior art rivet at formation.
Figure 6B:
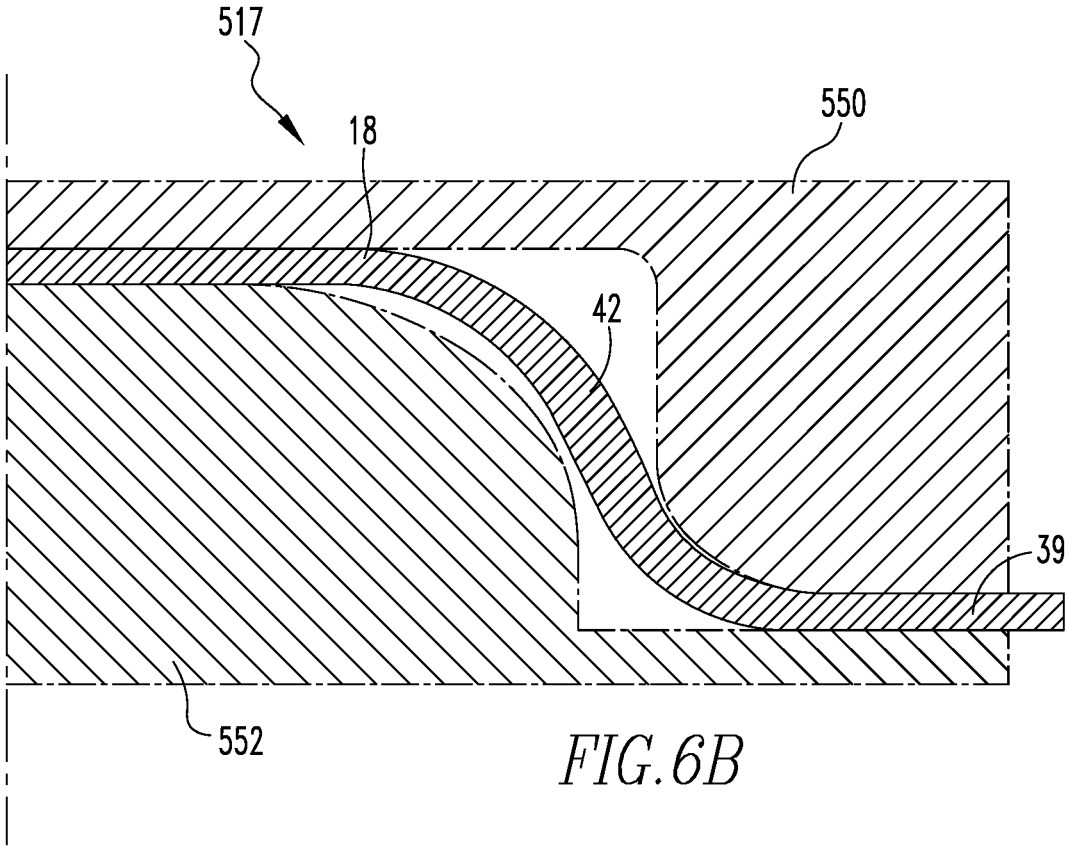
FIG. 6B is a detail view of a coined rivet at formation.

Further, as shown in FIG. 6A, it is noted that in the prior art, formation of a rivet button A included deforming the rivet portion sidewall portion B over, i.e., in contact with, the lower tooling C. As shown in FIG. 6B, the coining rivet station 514 is structured to, and does, allow the rivet portion sidewall portion 42 to gap, i.e., be spaced from, the lower tooling 572. This configuration is also generated because the top portion 18 and the bubble outer periphery 39 is coined. A press station 502, i.e., an upper tooling assembly 550 and a lower tooling assembly 552, that is structured to cause a rivet portion sidewall portion 42 that is disposed between two areas of coined material to be spaced from the tooling assemblies 550, 552, is, as used herein, an "gapped press station" and the tooling assemblies thereof are each a "gapped tooling assembly." Thus, in an exemplary embodiment, the coining rivet station 514 is a "gapped" coining rivet station 514 and the tooling assemblies 570, 572 thereof are "gapped" tooling assemblies 570, 572. Use of a gapped coining rivet station 514 allows for the thickness of the rivet portion sidewall portion 42, and the subsequently formed sidewall 16, to be thicker than the coined top portion 18. solving the problems stated above. That is, having a sidewall 16 that is thicker than the coined top portion 18 reduces the chance of a failure at the coined rivet 12 solving the problems stated above.

Figure 7:
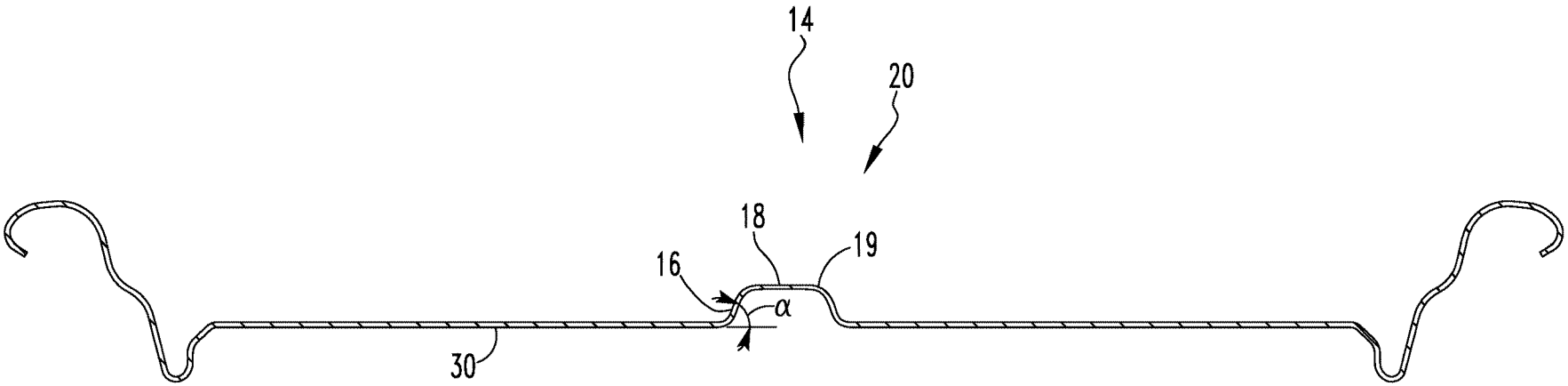
FIG. 7 is a cross-sectional side view of a blank with a rivet button.

In an exemplary embodiment, the blank 20 is then moved to a second rivet station 516, as shown in FIG. 7. The second rivet station 516 includes an upper tooling assembly that is generally similar to the coining rivet station 514, but does not include the equivalent to a coining rivet station upper tooling assembly central punch 576. In this configuration, there is nothing that opposes a second rivet station lower tooling assembly central punch 585. Thus, as a second rivet station upper tooling assembly outer annular punch 587 moves downwardly, the coined rivet button 14 is further formed over the second rivet station lower tooling assembly central punch 585 so as to have a generally perpendicular sidewall 16. The cross-sectional view of the blank shell 20 following formation in the second rivet station 516 is shown in FIG. 2.

Figure 8:
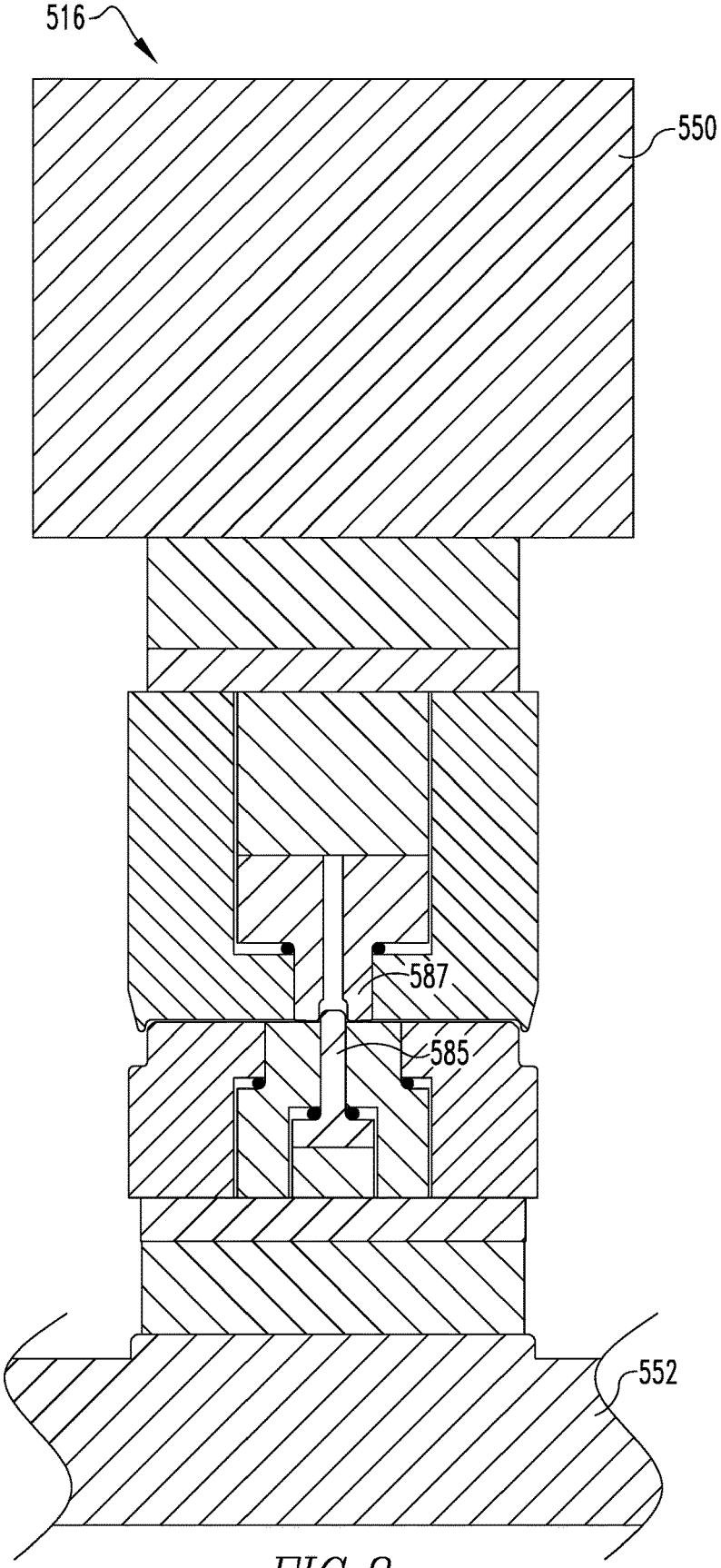
FIG. 8 is a cross-sectional side view of a second rivet station.

That is, when viewed in cross-section, the sidewall 16 is generally perpendicular to the plane of the central panel 30. The transition between the sidewall 16 and the coined rivet top portion 18 is, as used herein, the "peripheral upper edge" 19. Because the top portion 18 is coined, the peripheral upper edge 19 is structured to have a sharper bend than prior art transitions between a rivet button sidewall and the rivet button top portion. In an exemplary embodiment, the peripheral upper edge 19 has a radius of between about 0.012 inch and 0.031 inch. A transition between a rivet button sidewall and a rivet button top portion with a radius of between about 0.012 inch and 0.031 inch is, as used herein, a "reduced radius" peripheral upper edge 19. That is, the reduced radius peripheral upper edge 19 has, a radius of between about 0.012 inch and 0.031 inch, when viewed in cross-section, as shown in FIG. 2. A coined rivet button 14 in this configuration, i.e., a button with a generally perpendicular sidewall 16 and a coined rivet top portion 18, is, as used herein, a "square coined rivet button" 14', as shown in FIG. 8. A square coined rivet button 14' is structured to collapse, when staked, with an enhanced overlap of a tab body 47, as described below.

Figure 9:
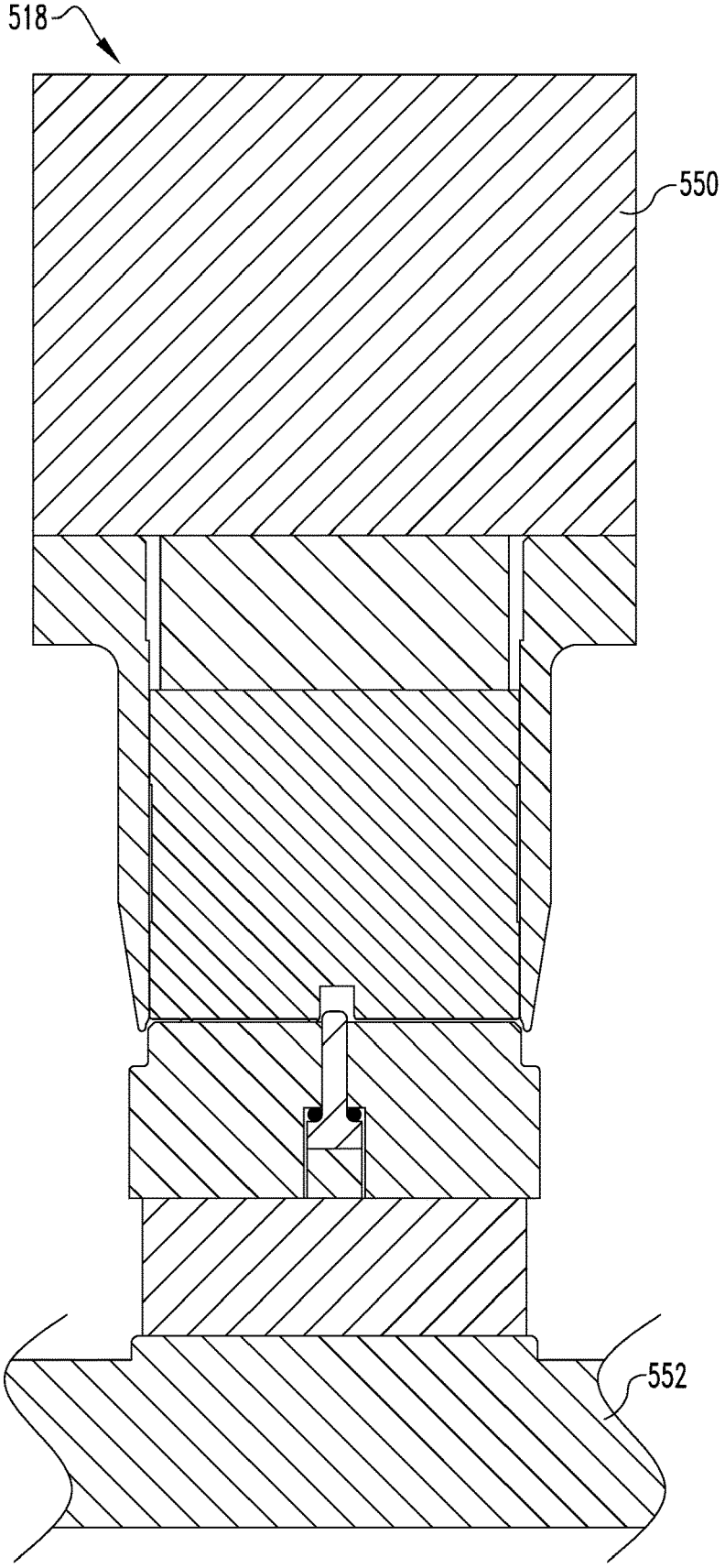
FIG. 9 is a cross-sectional side view of a score station.

The score station 518, FIG. 9, creates a number of scores (not shown) that define a tear panel as is known in the art. The panel station 520, FIG. 10, forms any additional formations, e.g., recessed portions, on the blank 20 as is known. In an exemplary embodiment, there are a number of panel stations 520. These stations are not relevant to the present disclosure.

The final station relevant to the present disclosure is the stake station 522, FIG. 11, that is structured to couple a tab 46 to the coined rivet button 14. The cross-sectional view of the blank shell 20 following formation in the stake station 522 is shown in FIG. 1. The stake station 522 includes the elements described in U.S. Pat. No. 5,755,134 and operates in a similar manner and the description of the staking process and the upper tooling assembly 550 and lower tooling assembly 552 described therein is incorporated by reference. It is generally noted that the stake station 522 includes an upper tooling assembly 590 with a staking punch 594 and staking adjustment spacer 596, and, a lower tooling assembly 592 with a primary anvil 598. The stake station lower tooling assembly primary anvil 598 has a smaller cross-sectional area than the coined rivet button 14 (or square coined rivet button 14'). It is noted that the stake station upper tooling assembly staking adjustment spacer 596 has an enhanced cross-sectional area. As used herein, an "enhanced cross-sectional area" for a stake station upper tooling assembly staking adjustment spacer 596 means that the cross-sectional area is structured to form a staked coined rivet 12 with an enhanced overlap of a tab body 47, as described below.

As shown in FIG. 1, the tab 46, shown schematically, includes an elongated, generally planar body 47 that defines a coupling opening 48. As is also known, the tab 46 is disposed over the coined rivet button 14 (or square coined rivet button 14'; hereinafter, it is understood that the discussion of the coined rivet button 14 also applies to the square coined rivet button 14'). That is, the coined rivet button 14 extends through the tab coupling opening 48. When a stake station upper tooling assembly staking punch 594 and the stake station upper tooling assembly staking adjustment spacer 596 move to their second position, the stake station upper tooling assembly staking punch 594 engages the coined rivet button top portion 18 thereby deforming the sidewall 16. Accordingly, the coined rivet button 14 is structured to be, and is, deformed to be a coined rivet 12.

Thus, the coined rivet button 14 has a first configuration, wherein the tab 46 is not captive on a coined rivet 12, and a second configuration, wherein the coined rivet button 14 is formed into a coined rivet 12 and wherein the tab 46 is captive on the coined rivet 12. Further, the coined rivet button 14 has a first maximum cross-sectional area, a first height, and sidewall 16 has a first thickness. The coined rivet 12, i.e., the coined rivet button 14 following staking/deformation, has a second maximum cross-sectional area, a second height, and the sidewall 16 has a second thickness. The coined rivet 12 second maximum cross-sectional area is greater than the coined rivet button 14 first maximum cross-sectional area, the coined rivet button 14 first height is greater than the coined rivet 12 second height, and the sidewall 16 second thickness is an enhanced thickness relative to the sidewall 16 first thickness. As used herein, an "enhanced thickness" means that the thickness of the sidewall 16 is greater than the base thickness of the sheet material.

Moreover, because the un-coined sidewall 16 is disposed between the coined metal of the central panel 30 and the coined rivet button top portion 18, the sidewall 16 deforms to a greater degree relative to a prior art rivet wherein the top portion is not coined. Thus, when deformed during the staking operation, the coined rivet button 14, and the sidewall 16, form a coined rivet 12 with an "enhanced overlap" of the tab body 47. As used herein, an "enhanced overlap" of a tab body means that the deformed sidewall 16 was formed from a square rivet button 14'. As used herein, a "square" rivet button 14' is a rivet button having a sidewall 16 which, when viewed in cross-section, has an angle ($\alpha$) of between about 70° and 90° or about 90° relative to the plane of the central panel 30. Further, to be a "square" rivet button 14, the peripheral upper edge 19 has a reduced radius. In an exemplary embodiment, the coined rivet 12 overlaps the sides of the tab coupling opening 48 by a minimum of 0.008 inch. This solves the problems stated above. A tab body 47 coupled to a can end 10 by a coined rivet 12 with an enhanced overlap of the tab body 47 is less likely to be decoupled from the can end 10 thereby solving the problems stated above. Further, the amount of metal of the sidewall 16 that deforms outwardly is increased when the sidewall 16 extends generally perpendicular to the plane of the central panel 30. Thus, a square coined rivet button 14', when deformed as described above, forms a "very enhanced overlap." That is, as used herein, a "very enhanced overlap" means the overlay of a tab 46 created when a square coined rivet button 14' is used to couple a tab 46 to a can end 10. This also solves the problems stated above.

Figure 12:
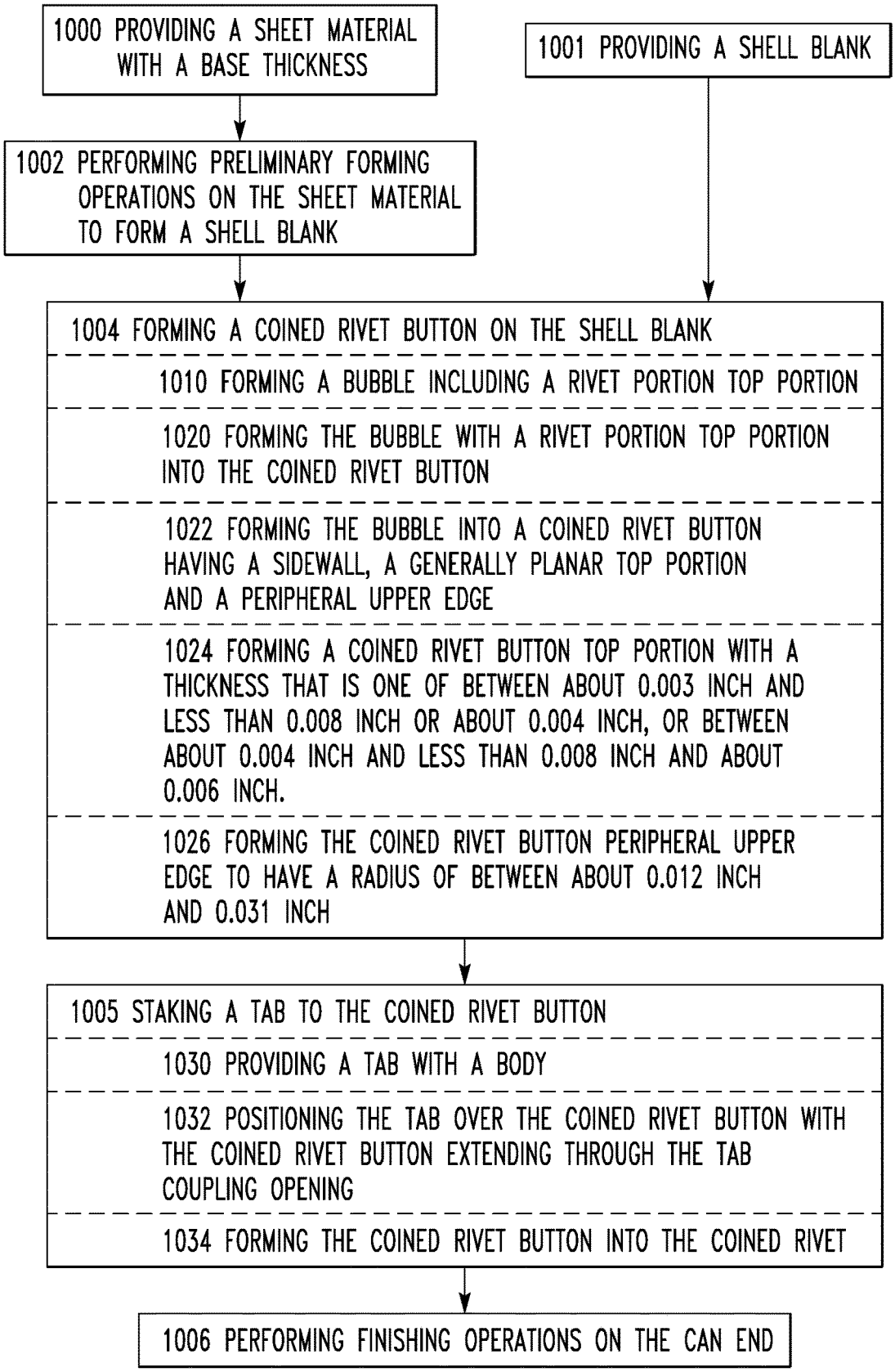
FIG. 12 is a flowchart of the disclosed method.

Accordingly, as shown in FIG. 12, a method of forming a can end 10 with a coined rivet 12 includes: providing 1000 a sheet material 22 with a base thickness, performing 1002 preliminary forming operations on the sheet material to form a shell blank, forming 1004 a coined rivet button 14 on the shell blank 20, staking 1005 a tab 46 to the coined rivet button 14 and performing 1006 finishing operations on the can end 10. Performing 1002 preliminary forming operation on the sheet material to form a shell blank 20 includes forming a central panel 30, an annular countersink 32, a chuck wall 34, and a curl 36, as is known. Alternately, the method of forming a can end 10 with a coined rivet 12 includes providing 1001 a shell blank 20 having a central panel 30, an annular countersink 32, a chuck wall 34, and a curl 36. As used herein, "finishing operations" include, but are not limited to, scoring the shell blank 20, paneling the shell blank 20, inspection of the shell blank 20, or applying coatings and/or other surface treatments to the shell blank 20.

In an exemplary embodiment, forming 1004 a coined rivet button on the shell blank 20 includes forming 1010 a bubble including a rivet portion top portion 44, forming 1020 the bubble with a rivet portion top portion 44 into the coined rivet button 14, and/or forming 1022 the bubble into a coined rivet button having a sidewall 16, a generally planar top portion 18 and a peripheral upper edge 19, forming 1024 a coined rivet button top portion with a thickness that is one of between more than about 0.003 inch and less than 0.0082 inch or about 0.004 inch, or, between about 0.004 inch and less than 0.0082 inch or about 0.006 inch, and/or forming 1026 the coined rivet button peripheral upper edge 19 to have a radius of between about 0.012 inch and 0.031 inch forming 1026 a coined rivet button top portion with a thickness that is one of between more than about 0.003 inch and less than 0.0082 inch or about 0.004 inch, or, between about 0.004 inch and less than 0.0082 inch or about 0.006 inch.

Further, in an exemplary embodiment, staking 1005 a tab 46 to the coined rivet button 1 includes providing 1030 a tab 46 with a body 47, the tab body 47 including a coupling opening 48, positioning 1032 the tab 46 over the coined rivet button 14 with the coined rivet button 14 extending through the tab coupling opening 48, forming 1034 the coined rivet button 14 into the coined rivet 12, and wherein the coined rivet 12 has an enhanced overlap of the tab body 47.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A press structured to form a can end from sheet material, said sheet material having a base thickness, said sheet material formed into a shell including a bubble, said bubble including a rivet portion top portion, said can end having a product side and a public side, said press comprising:

a frame;

an upper tooling assembly including a first coining surface, said upper tooling assembly movably coupled to said frame;

a lower tooling assembly including a second coining surface, said lower tooling assembly coupled to said frame;

said first coining surface structured to move between a first position, wherein said first coining surface is spaced from said second coining surface, and a second position, wherein said first coining surface is a coining distance from said second coining surface;

said first coining surface and said second coining surface structured to simultaneously engage opposing sides of a center of the rivet portion top portion disposed between said first coining surface and said second coining surface; and wherein, when said first coining surface and said second coining surface are in said second position, said first coining surface and said second coining surface coin the rivet portion top portion including the center of the rivet portion top portion to form a coined rivet top portion from the rivet portion top portion including the center of the rivet portion top portion.

2. The press of claim 1 wherein:

said upper tooling assembly includes an upper punch;

said upper punch including a body with an upper end and a lower end;

said first coining surface disposed on said lower end of said body of said upper punch; and said upper punch structured to move between a first upper punch position, wherein said upper punch is spaced from said lower tooling assembly, and a second upper punch position, wherein said upper punch is immediately adjacent said lower tooling assembly.

3. The press of claim 1 wherein:

said lower tooling assembly includes a lower punch;

said lower punch including a body with an upper end and a lower end;

said second coining surface disposed on said upper end of said body of said lower punch; and said lower punch structured to move between a first lower punch position, wherein said lower punch is spaced from said upper tooling assembly, and a second lower punch position, wherein said lower punch is immediately adjacent said upper tooling assembly.

4. The press of claim 3 wherein said lower punch body is structured to form said bubble into a rivet button.

5. The press of claim 3 wherein:

said body of said lower punch is structured to form said bubble into a coined rivet button having a sidewall and a generally planar top portion; and wherein said sidewall and said planar top portion of said coined rivet button meet at a reduced radius peripheral upper edge.

6. The press of claim 5 wherein said planar top portion of said coined rivet button has a thickness of between 0.003 inch and less than 0.0082 inch.

7. The press of claim 5 wherein said planar top portion of said coined rivet button has a thickness of 0.004 inch.

* * * * *